US010684572B2

(12) United States Patent
Wakai et al.

(10) Patent No.: US 10,684,572 B2
(45) Date of Patent: Jun. 16, 2020

(54) DEVELOPING DEVICE AND IMAGE FORMING APPARATUS

(71) Applicant: FUJI XEROX CO., LTD., Tokyo (JP)

(72) Inventors: Takafumi Wakai, Kanagawa (JP); Takashi Akaike, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/916,334

(22) Filed: Mar. 9, 2018

(65) Prior Publication Data

US 2019/0041769 A1 Feb. 7, 2019

(30) Foreign Application Priority Data

Aug. 1, 2017 (JP) ..... 2017-149343

(51) Int. Cl.
*G03G 15/08* (2006.01)
*G03G 15/20* (2006.01)
*G03G 15/09* (2006.01)

(52) U.S. Cl.
CPC ..... *G03G 15/08* (2013.01); *G03G 15/0812* (2013.01); *G03G 15/0942* (2013.01); *G03G 15/2028* (2013.01); *G03G 2215/0634* (2013.01)

(58) Field of Classification Search
CPC ..... G03G 15/0898; G03G 15/0942; G03G 21/0052; G03G 2221/0094
See application file for complete search history.

(56) References Cited

U.S. PATENT DOCUMENTS 4,194,465 A * 3/1980 Tsukamoto ..... G03G 15/0898 399/103
5,708,921 A * 1/1998 Yagi ..... G03G 15/0815 399/149
7,043,172 B2 * 5/2006 Koshimura ..... G03G 15/0898 399/119
7,340,195 B2 * 3/2008 Watanabe ..... G03G 21/0052 399/103

(Continued)

FOREIGN PATENT DOCUMENTS

JP 01-077669 U * 5/1989
JP 08-190265 A 7/1996

(Continued)

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

A developing device includes a housing including a development opening and a containing unit that contains a developer, a developer carrier that rotates to pass through the development opening while holding the developer in the containing unit of the housing, an inlet portion of a flow path located in the housing at a portion including a downstream edge portion of the development opening on a downstream side in a rotation direction of the developer carrier, the inlet portion taking in part of an airflow caused by a rotation of the developer carrier to allow the part of the airflow to flow over an outer surface of the housing, and a guide member extending toward the developer carrier from a portion of the housing on a side of the inlet portion opposite to the development opening to guide the part of the airflow to the inlet portion.

19 Claims, 12 Drawing Sheets

(56) References Cited

U.S. PATENT DOCUMENTS

| | | | | |
|---|---|---|---|---|
| 7,826,775 | B2 * | 11/2010 | Nakayama | G03G 15/0921 399/254 |
| 2010/0296834 | A1 * | 11/2010 | Omori | G03G 15/0898 399/99 |
| 2012/0251155 | A1 * | 10/2012 | Ishikawa | G03G 15/0806 399/92 |

FOREIGN PATENT DOCUMENTS

| | | | |
|---|---|---|---|
| JP | 09-54494 | A | 2/1997 |
| JP | 2015-79134 | A | 4/2015 |

* cited by examiner

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-149343 filed Aug. 1, 2017.

BACKGROUND

Technical Field

The present invention relates to a developing device and an image forming apparatus.

SUMMARY

According to an aspect of the invention, a developing device includes a housing including a development opening and a containing unit that contains a developer, a developer carrier that rotates to pass through the development opening while holding the developer in the containing unit of the housing, an inlet portion of a flow path located in the housing at a portion including a downstream edge portion of the development opening on a downstream side in a rotation direction of the developer carrier, the inlet portion taking in part of an airflow caused by a rotation of the developer carrier to allow the part of the airflow to flow over an outer surface of the housing, and a guide member extending toward the developer carrier from a portion of the housing on a side of the inlet portion of the flow path opposite to the development opening to guide the part of the airflow to the inlet portion of the flow path.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings.

First Exemplary Embodiment

Figure 1:
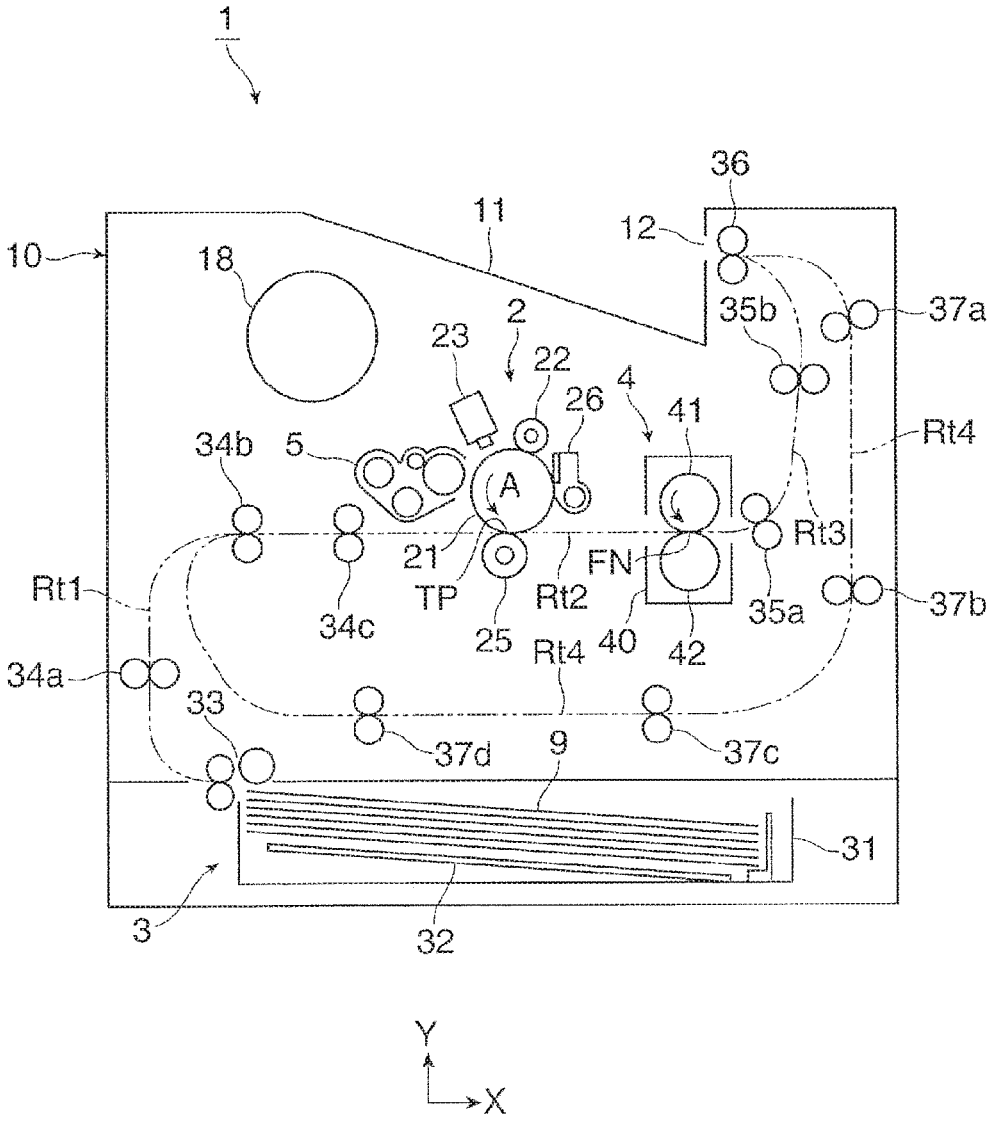
FIG. 1 is a schematic view of the entirety of an image forming apparatus according to a first exemplary embodiment.
Figure 2:
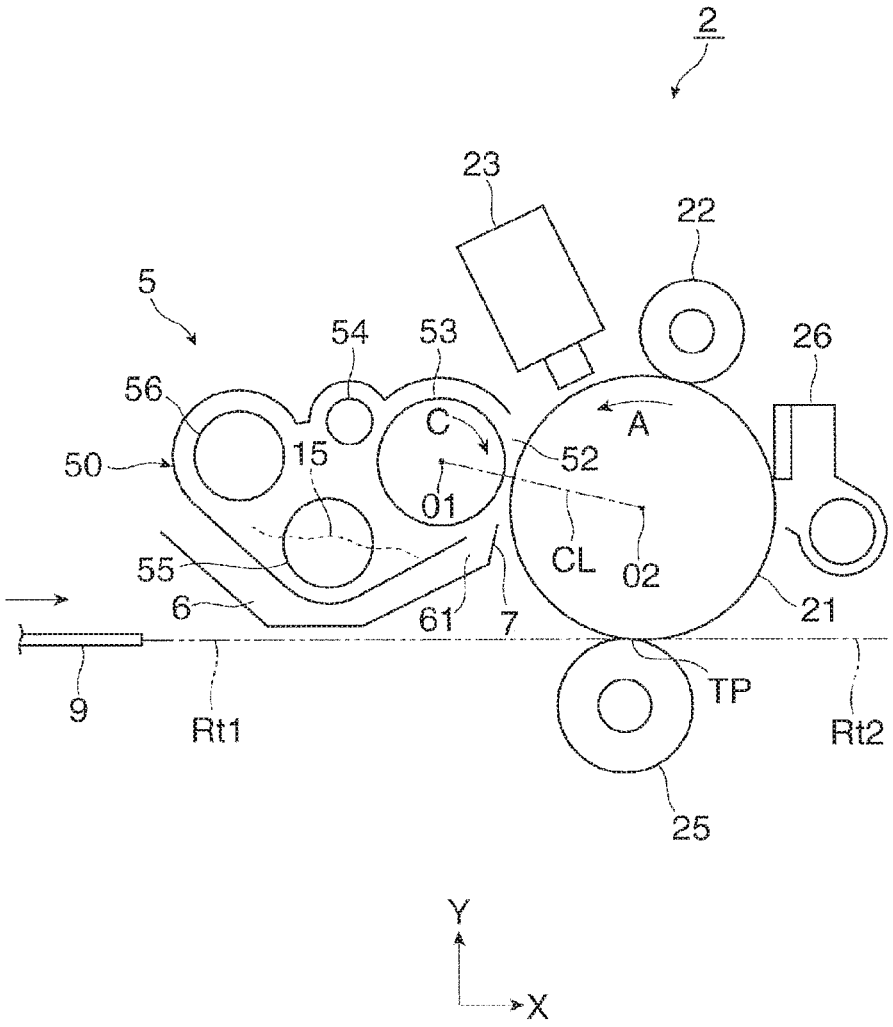
FIG. 2 is an enlarged schematic view of a portion (including an image forming device) of the image forming apparatus illustrated in FIG. 1.
Figure 3:
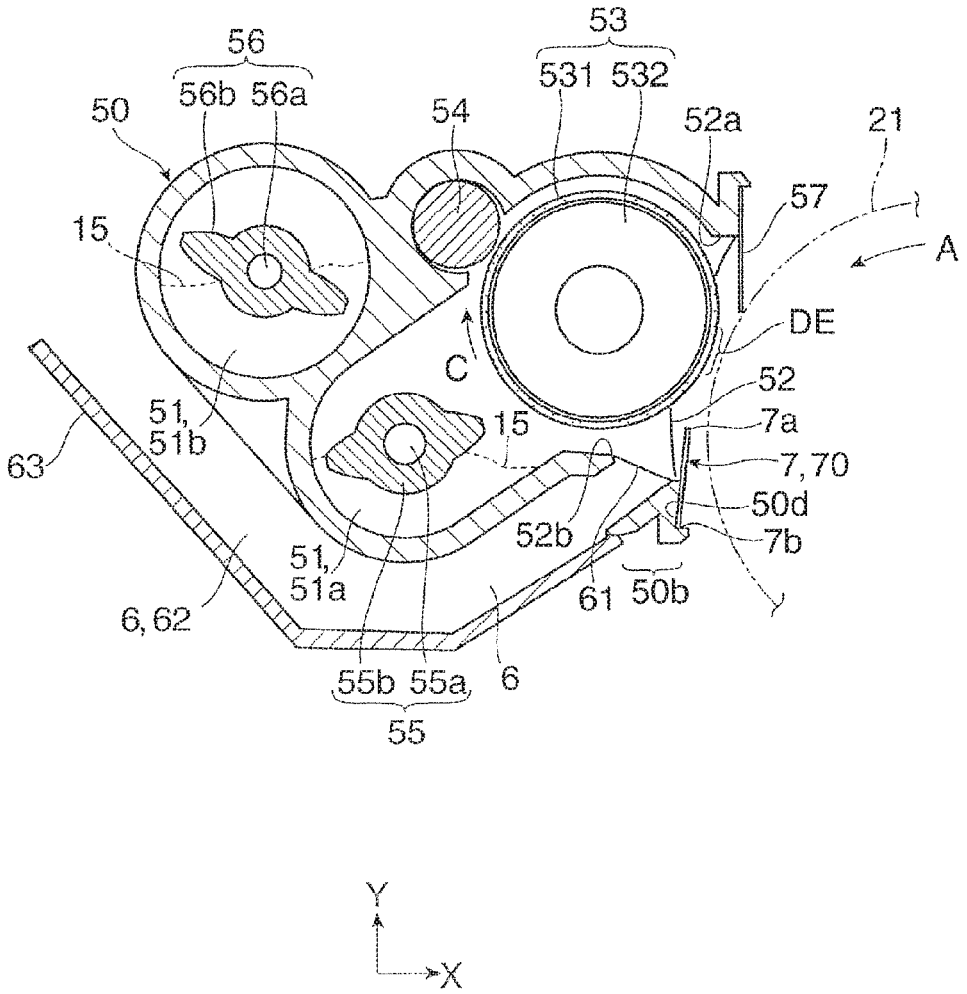
FIG. 3 is a sectional schematic view of a developing device of the image forming apparatus illustrated in FIG. 1.

FIG. 1 to FIG. 3 illustrate a first exemplary embodiment of the present invention. FIG. 1 illustrates a structure of an image forming apparatus 1 including a developing device according to the first exemplary embodiment. FIG. 2 is an enlarged view of a portion of the image forming apparatus 1 (including an image forming device). FIG. 3 is an enlarged view of a structure of a developing device included in the image forming apparatus 1.

Structure of Entirety of Image Forming Apparatus

An image forming apparatus 1 is a printer, which is an example of an image forming apparatus. The image forming apparatus 1 forms an image on a recording sheet 9, which is an example of a recording medium, using a developer (toner). The image is based on externally input image information including characters, photos, and shapes.

As illustrated in FIG. 1, the image forming apparatus 1 includes, inside a housing 10 serving as an apparatus body, an image forming device 2, which forms a toner image from toner serving as a developer with a method such as an electrophotographic system and transfers the toner image to a recording sheet 9, a sheet feeder 3, which houses predetermined recording sheets 9 and feeds the sheets 9 to a transfer position of the image forming device 2, and a fixing device 4, which fixes a toner image transferred to a recording sheet 9 to the recording sheet 9.

The housing 10 includes various different components such as a structural component and an exterior member. The housing 10 includes, at its upper portion, a discharged sheet receiver 11, which receives recording sheets 9 discharged after undergoing image formation. The discharged sheet receiver 11 includes a receiving surface, which is an inclined surface disposed below an outlet portion 12 in the housing 10, to receive the recording sheets 9 discharged from the outlet portion 12.

As illustrated in FIG. 1 or FIG. 2, the image forming device 2 includes a charging device 22, an exposure device 23, a developing device 5, a transfer device 25, and a cleaning device 26 arranged in this order around a photoconductor drum 21, which rotates in a direction of arrow A.

The charging device 22 is, for example, a contact charging device that charges the peripheral surface (outer peripheral surface portion serving as an image forming area) of the photoconductor drum 21 to a predetermined polarity and potential. The exposure device 23 irradiates the charged peripheral surface of the photoconductor drum 21 with light corresponding to image information (signal) input into the image forming apparatus 1 in various manners to form an electrostatic latent image on the photoconductor drum 21. The developing device 5 feeds toner, serving as a developer, to develop the electrostatic latent image on the photoconductor drum 21 into a toner image. The transfer device 25 is, for example, a contact transfer device that electrostatically transfers a toner image on the photoconductor drum 21 to the recording sheet 9. The cleaning device 26 removes unwanted objects such as toner adhering to and remaining on the peripheral surface of the photoconductor drum 21 to clean the photoconductor drum 21.

The developing device 5 is described below.

The sheet feeder 3 is placed below and apart from the image forming device 2 in the direction of gravity. The sheet feeder 3 includes a sheet container 31 and a feeding device 33. The sheet container 31 contains multiple recording sheets 9 of a predetermined size and type suitable for forming an image, stacked on a mount plate 32. The feeding device 33 feeds the recording sheets 9 contained in the sheet container 31 one by one.

The sheet container 31 is removably attached to the housing 10. Multiple sheet containers 31 may be disposed as appropriate. Examples of the recording sheets 9 include recording media such as ordinary sheets, coated paper sheets, or boards cut in a predetermined size.

The fixing device 4 is spaced apart from the image forming device 2 in a substantially horizontal direction (in the direction substantially parallel to the coordinate axis X). The fixing device 4 includes a housing 40, having an inlet portion and an outlet portion, and a heating rotatable body 41 and a pressing rotatable body 42, disposed in the housing 40 and touching each other and rotate.

As illustrated in FIG. 1, the heating rotatable body 41 is a heating fixing member of a roller form, a belt form, or another form that rotates in the direction indicated with the arrow and heated by a heating device, not illustrated, to have its peripheral surface kept at a predetermined temperature. The pressing rotatable body 42 is a pressing fixing member of a roller form, a belt form, or another form driven to rotate in contact with the heating rotatable body 41 at a predetermined pressure substantially along the axis of the heating rotatable body 41. The fixing device 4 includes a fixing processor FN at a portion at which the heating rotatable body 41 and the pressing rotatable body 42 are in contact with each other. The fixing processor FN allows a recording sheet 9 having a toner image transferred thereto and not fixed to the recording sheet 9 to pass therethrough to perform a predetermined fixing operation on (to heat and press) the recording sheet 9.

As indicated with two-dot chain lines Rt1, Rt2, Rt3, and Rt4 in FIG. 1, the image forming apparatus 1 has sheet transport paths for the recording sheets 9 inside the housing 10.

The sheet transport paths include a feed transport path Rt1, disposed between the feeding device 33 of the sheet feeder 3 and a transfer position TP (a position of the photoconductor drum 21 facing the transfer device 25) of the image forming device 2, a relay transport path Rt2, disposed between the transfer position TP of the image forming device 2 and the fixing processor FN of the fixing device 4, a discharge transport path Rt3, disposed between the fixing processor of the fixing device 4 and the discharged sheet receiver 11 of the housing 10, and a double-sided printing transport path Rt4, disposed between the terminal (point of divergence) of the discharge transport path Rt3 and a middle (juncture) of the feed transport path Rt1.

The feed transport path Rt1 is a path having a substantially lying letter-U shape as a whole and including multiple pairs of transport rollers 34*a*, 34*b*, and 34*c* and multiple transport guide members, not illustrated. The pair of transport rollers 34*c* serve as a pair of registration rollers that start rotating at a transfer timing to feed the recording sheet 9 toward the transfer position TP of the image forming device 2.

The relay transport path Rt2 is a path extending substantially horizontally as a whole and including multiple transport guide members, not illustrated.

The discharge transport path Rt3 is a path curved to be erect as a whole and including multiple pairs of transport rollers 35*a*, 35*b*, and 36 and multiple transport guide members, not illustrated. The pair of transport rollers 36 are disposed in front of the outlet portion 12 to serve as discharge rollers that feed the recording sheet 9 subjected to fixing to the discharged sheet receiver 11.

The double-sided printing transport path Rt4 includes the pair of discharging rollers 36, which are rotatable forward and backward and serve as the terminal of the discharge transport path Rt3, multiple pairs of transport rollers 37*a*, 37*b*, 37*c*, and 37*d*, a direction switching member that is not illustrated and switches the direction of the recording sheet 9, and multiple transport guide members, not illustrated.

Image Forming Operation of Image Forming Apparatus

The image forming apparatus 1 forms images in the following manner. Here, a basic image forming operation for forming an image on one surface of the recording sheet 9 is described as an example.

When a controller, not illustrated, of the image forming apparatus 1 receives a command (signal) for starting an image forming operation from, for example, an information terminal connected thereto through various communication devices, the image forming device 2 of the image forming apparatus 1 starts an image forming operation to form a toner image.

In the image forming device 2, the photoconductor drum 21 starts rotating, first. The charging device 22 charges the peripheral surface of the photoconductor drum 21 to a predetermined polarity and potential (a negative polarity in this example), and then the exposure device 23 exposes the charged peripheral surface of the photoconductor drum 21 to light based on the image information to form an electrostatic latent image having an intended pattern. Thereafter, the developing device 5 develops the electrostatic latent image formed on the peripheral surface of the photoconductor drum 21 with toner, which is a developer charged to a predetermined polarity (a negative polarity in this example), to render the electrostatic latent image visible as a toner image. Thus, a toner image is formed on the photoconductor drum 21.

Subsequently, in the image forming device 2, the rotating photoconductor drum 21 transports the toner image to a transfer position TP opposing the transfer device 25. On the other hand, the sheet feeder 3 feeds a recording sheet 9 to the feed transport path Rt1 at the transfer timing to transport the recording sheet 9 up to the transfer position TP of the image forming device 2. At the transfer position TP of the image forming device 2, the transfer device 25 forms a transfer electric field to electrostatically transfer the toner image on the photoconductor drum 21 to one surface of the recording sheet 9. In the image forming device 2, the cleaning device 26 continuously cleans the peripheral surface of the photoconductor drum 21 during a period including the time after the transfer.

Subsequently, the recording sheet 9 to which the toner image has been transferred is fed to the relay transport path Rt2 and transported to the fixing device 4 by a transport force that the recording sheet 9 receives from the rotating photoconductor drum 21 and the transfer device 25 while being held between them. The fixing device 4 introduces the recording sheet 9 into the fixing processor FN between the rotating heating rotatable body 41 and the pressing rotatable body 42 and allows the recording sheet 9 to pass therethrough. When the recording sheet 9 passes the fixing processor FN, the toner image on one surface of the recording sheet 9 has its toner heated under pressure and melt to be fixed to the recording sheet 9.

The recording sheet 9 that has undergone fixing is fed from the fixing processor FN of the fixing device 4 to the discharge transport path Rt3, and then discharged by the pair of discharging rollers 36 through the outlet portion 12 of the housing 10 to be finally held in the discharged sheet receiver 11.

Thus, a single-color image formed of a single-color toner is formed on a single surface of a recording sheet 9 to finish an image forming operation on a single surface. When a command to perform an image forming operation on multiple sheets is issued, a series of processes described above is repeated the number of times corresponding to the number of sheets.

In a double-sided image forming operation for forming images on both top and bottom surfaces of the recording sheet 9, the image forming operation on a single surface is performed in the same manner as above, and then the recording sheet 9 subjected to fixing of the toner image transferred to the single surface (first surface or top surface) is fed to the double-sided printing transport path Rt4.

The recording sheet 9 having the single surface to which the toner image has been fixed is temporarily discharged from the outlet portion 12 and stopped while having its transportation leading end portion held between the pair of discharging rollers 36. Then, the recording sheet 9 has its transportation trailing end portion fed into the double-sided printing transport path Rt4 with a switching operation for switching the direction of the direction switching member and a reverse operation of the pair of discharging rollers 36.

Subsequently, the recording sheet 9 fed into the double-sided printing transport path Rt4 is transported through the double-sided printing transport path Rt4 to a position in front of the pair of transport rollers 34*b* in the feed transport path Rt1 to flow into the feed transport path Rt1. Thus, the recording sheet 9 is fed into the feed transport path Rt1 while being turned over.

Then, the recording sheet 9 fed again to the feed transport path Rt1 is fed to the transfer position TP of the image forming device 2 at the transfer timing, as in the case of the single-side image forming operation, to have a toner image transferred to its another surface (second surface or back surface). Thereafter, the recording sheet 9 is transported to the fixing device 4 to have the toner image fixed thereto. As in the above described case, the recording sheet 9 having images on both top and back surfaces is finally discharged to and held by the discharged sheet receiver 11.

In this manner, single-color images formed of a single-color toner are formed on both top and back surfaces of a recording sheet 9 to finish the double-sided image forming operation.

Structure of Developing Device

The developing device 5 is described now.

As illustrated in FIG. 2, FIG. 3, and other drawings, the developing device 5 includes a housing 50, which holds the above components arranged therein. The components in the housing 50 include a development roller 53, a layer-thickness restricting member 54, and two agitation transporting members 55 and 56.

The housing 50 is a structure having an external shape extending in one direction as a whole. As illustrated in FIG. 3 and other drawings, the housing 50 includes a containing unit 51, which holds a developer 15, and a development opening 52, which exposes a portion of the containing unit 51 facing the photoconductor drum 21.

The housing 50 has, for example, a divisible structure including a body (housing bottom), which constitutes a lower structure of the housing 50, and a lid (housing top), which covers the upper portion of the body and constitutes an upper structure of the housing 50. An example used as the developer 15 is a binary developer, which contains nonmagnetic toner, formed from fine colored (black or the like) powder, and a magnetic carrier, formed from magnetic particles.

The containing unit 51 of the housing 50 includes two transport paths 51*a* and 51*b* (first transport path 51*a* and second transport path 51*b*) extending parallel to the axial direction of the development roller 53.

The two transport paths 51*a* and 51*b* extend linearly parallel to the longitudinal direction of the housing 50, and are located slightly different from each other in the vertical direction. The two transport paths 51*a* and 51*b* are partitioned from each other by a partitioning wall at the middle therebetween. The two transport paths 51*a* and 51*b* are connected to each other at connection portions at the upstream and downstream end portions in the transportation direction that have no partitioning wall. The two transport paths 51*a* and 51*b* together form a circular passage structure. Of the two transport paths 51*a* and 51*b*, the first transport path 51*a*, which is closer to the development roller 53, is mainly used as a feeding transport path for feeding the developer to the development roller 53, and the second transport path 51*b*, which is further from the development roller 53, is mainly used as a mixing transport path for mixing the held developer with additionally fed toner and the like.

The development opening 52 exposes part of the development roller 53 to the outside to allow the development roller 53 to perform a development operation. Thus, the development opening 52 has a rectangular shape having a dimension slightly larger than that of the image formable area in the direction of, for example, the rotation shaft of the photoconductor drum 21. FIG. 3 also illustrates a leak preventive member 57, or a seal member, which prevents the developer (mainly toner) from leaking through a gap between the developing device 5 and the photoconductor drum 21 or a gap between the development opening 52 of the housing 50 and the development roller 53.

The development roller 53 holds the developer in the containing unit 51 on its outer peripheral surface with its magnetic force. The development roller 53 transports the developer to a surface portion DE, which faces the outer peripheral surface of the photoconductor drum 21 at a predetermined distance and serves as a development operation area and allows the developer to pass therethrough. The development operation area is an area having a predetermined width with respect to a straight line CL (FIG. 2), connecting a rotation center 01 of the development roller 53 to a rotation center 02 of the photoconductor drum 21, or an area to which the magnetic force of development magnetic polarities arranged in a magnetic roller 532 of the development roller 53, described below, is effectively exerted.

As illustrated in FIG. 3, the development roller 53 includes a sleeve 531, which is an example of a cylindrical member rotatable in the housing 50 while being exposed through the development opening 52, and a magnetic roller 532, which is an example of a magnetic member fixed in the cylindrical space inside the sleeve 531.

Figure 4:
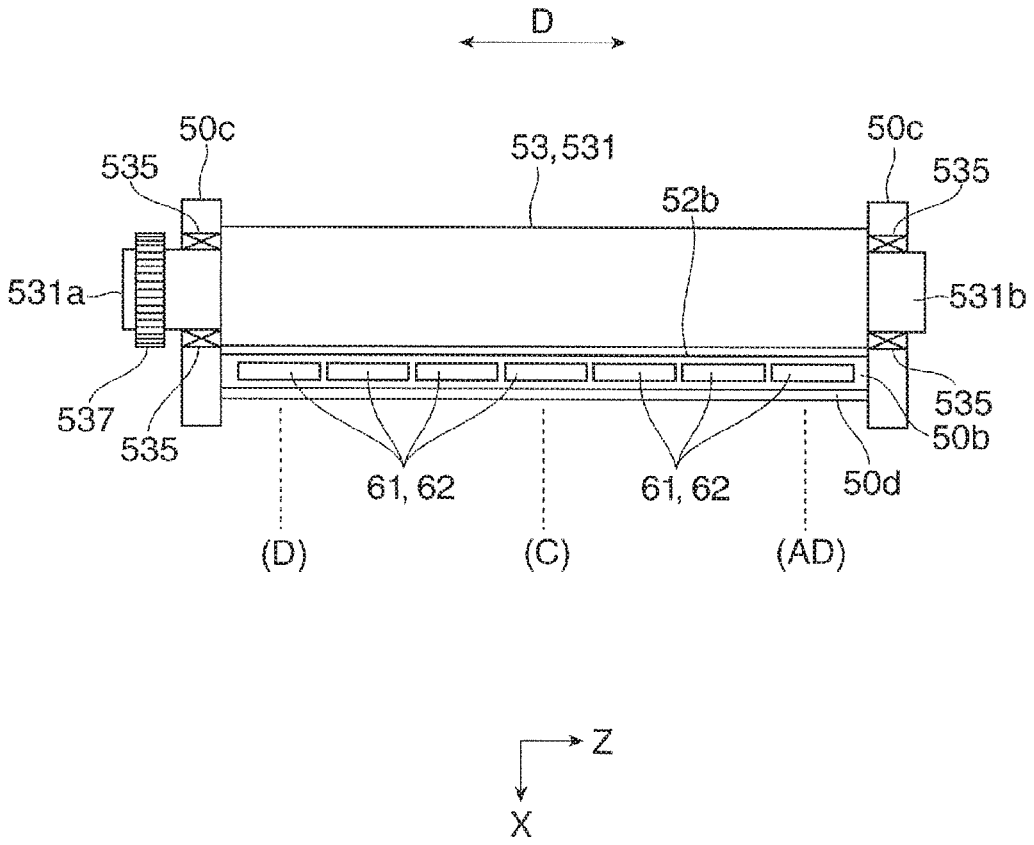
FIG. 4 is an enlarged schematic view of a portion of the developing device illustrated in FIG. 3 (excluding a guide member)

The sleeve 531 is a cylindrical member made of a non-magnetic material such as stainless steel or aluminum. As illustrated in FIG. 4, for example, the sleeve 531 includes shafts 531*a* and 531*b* at both end portions. The shafts 531*a* and 531*b* are rotatably attached to receiving portions 50*c* at side walls of the housing 50 with members such as bearings 535 interposed therebetween. For example, a gear 537 is attached to the shaft 531*a* of the sleeve 531. The gear 537 rotates in the direction of arrow C when receiving rotational power transmitted through a gear train and the like from, for example, a rotational driving device, not illustrated. A power supply device, not illustrated, applies a development voltage applied between the sleeve 531 and the photoconductor drum 21.

Figure 7:
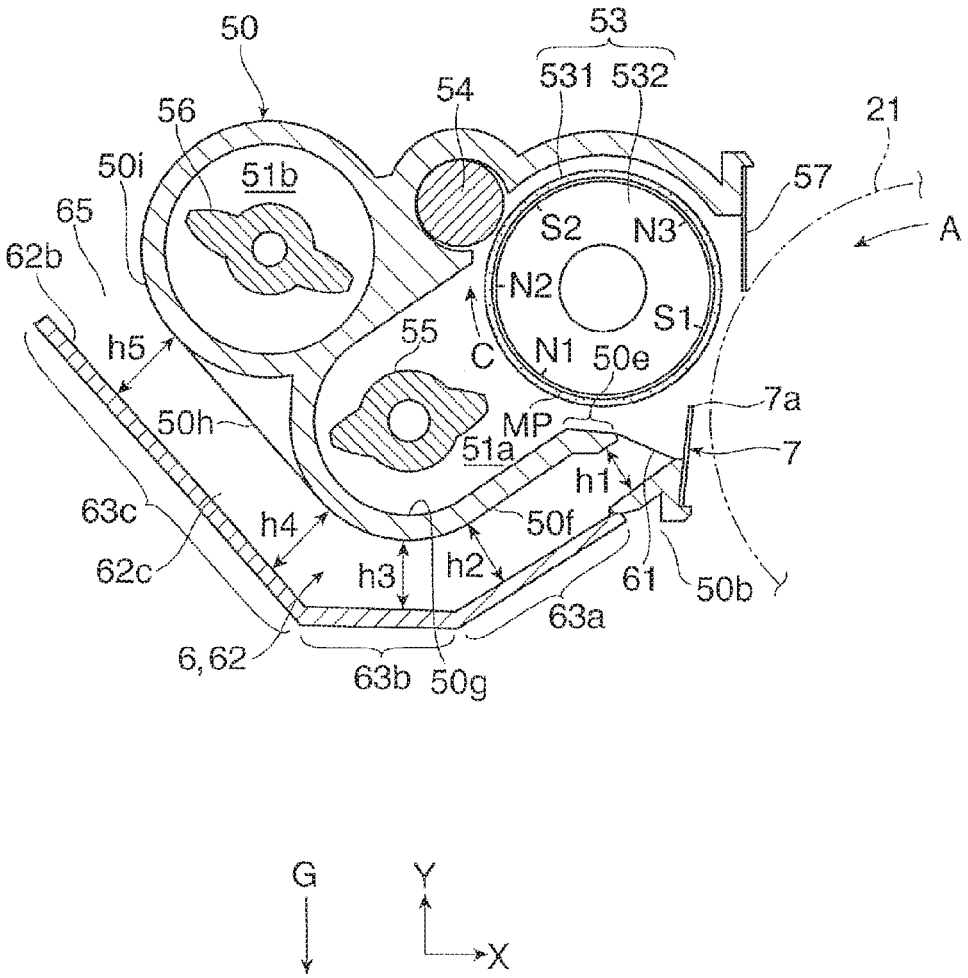
FIG. 7 is a sectional schematic view of a structure of an airflow processing path or a magnetic polarity arrangement in the developing device.

The magnetic roller 532 has a structure including multiple magnetic polarities (S pole and N pole) arranged at predetermined positions and exerting a magnetic force to attract the magnetic carrier of the developer to the outer peripheral surface of the sleeve 531 so that the magnetic carrier forms a chain-like continuous magnetic brush along the line of magnetic force. FIG. 7 illustrates a development magnetic polarity S1, a release magnetic polarity N1, an attraction magnetic polarity N2, a thickness-adjustment magnetic polarity S2, and a transportation magnetic polarity N3.

For example, the magnetic roller 532 is fixed and attached to the receiving portions 50*c* at the side walls of the housing 50 while having the shafts protruding from both end portions extending through the inner spaces of the shafts 531*a* and 531*b* of the sleeve 531.

The layer-thickness restricting member 54 restricts the thickness of the developer (magnetic brush) held on the sleeve 531 of the development roller 53 to a substantially uniform thickness.

The layer-thickness restricting member 54 is fixed and attached to a receiving portion of the housing 50 while continuously facing the outer peripheral surface of the sleeve 531 of the development roller 53 at a predetermined distance (restriction distance) corresponding to the required thickness of the developer, and while extending in a direction D of the rotation shafts (shafts) of the sleeve 531. An example usable as the layer-thickness restricting member 54 is a solid cylindrical member having a length equal to or longer than the length of the effective development area in the direction of the rotation shaft of the development roller 53 (sleeve 531), more specifically, a member made of a non-magnetic material such as stainless steel. The layer-thickness restricting member 54 is disposed upstream of (above), in the gravitational direction, the rotation center of the development roller 53 (for example, rotation center of the shafts 531*a* of the sleeve 531).

As illustrated in FIG. 2 and FIG. 3, the two agitation transporting members 55 and 56 are respectively disposed in the first transport path 51*a* and the second transport path 51*b* of the housing 50 to transport the developer 15 contained in the respective transport paths 51*a* and 51*b* in intended directions (in the transportation directions of the transport paths 51*a* and 51*b*) while agitating the developer 15.

An example used as both agitation transporting members 55 and 56 is a structure including a plate-shaped transportation portion 55*b* or 56*b* helically wound around the peripheral surface of a rotation shaft 55*a* or 56*a* (so-called screw auger). The rotation shafts 55*a* and 56*a* of the agitation transporting members 55 and 56 have both end portions rotatably attached to bearings, not illustrated, disposed at the side wall surfaces of the housing 50. Each of the rotation shafts 55*a* and 56*a* of the agitation transporting members 55 and 56 has one end portion to which a gear, not illustrated, is attached. The agitation transporting members 55 and 56 thus rotate in predetermined directions while receiving rotational power distributed from the development roller 53 (sleeve 531).

Basic Operation of Developing Device

When the image forming apparatus 1 performs an operation such as an image forming operation, the sleeve 531 of the development roller 53 and the agitation transporting members 55 and 56 start rotating in the developing device 5 having the above structure and a development voltage is fed to the sleeve 531 of the development roller 53.

Thus, the binary developer 15 contained in the containing unit 51 of the housing 50 is transported in the predetermined transportation directions through the first transport path 51*a* and the second transport path 51*b* of the containing unit 51 while being agitated by the rotating agitation transporting members 55 and 56. The developer 15 is transported to move from each of the transport paths 51*b* and 51*a* to the other path at the ends of the transport paths 51*a* and 51*b* through connection portions, not illustrated. When the containing unit 51 is viewed as a whole, the developer 15 is transported to circulate inside the containing unit 51. Here, the developer 15 has its nonmagnetic toner fully mixed with the magnetic carrier to be charged by friction and electrostatically adhering to the surface of the magnetic carrier.

Subsequently, part of the developer 15 transported by the agitation transporting member 55 disposed closer to the development roller 53 is adhered to and held on the outer peripheral surface of the sleeve 531 of the development roller 53 by the magnetic force caused by the magnetic polarities of the magnetic roller 532. At this time, the developer is held while keeping the magnetic brush spiked on the outer peripheral surface of the rotating sleeve 531. While being transported by the rotation of the sleeve 531 in the direction of arrow C, the held developer passes through a predetermined gap (restriction gap) between the sleeve 531 and the layer-thickness restricting member 54 to have its thickness restricted to a substantially uniform thickness (height of the magnetic brush).

Subsequently, the developer 15 that has passed through the layer-thickness restricting member 54 is transported to the development operation area DE, at which it faces the photoconductor drum 21, after passing through the development opening 52 with the rotation of the sleeve 531 in the direction of arrow C. The developer that has been transported to the development operation area DE has its magnetic brush end in contact with the outer peripheral surface of the photoconductor drum 21 while passing the photoconductor drum 21. When the developer passes the photoconductor drum 21, only the toner of the developer is electrostatically adhered to a portion of the electrostatic latent image on the photoconductor drum 21 while reciprocating between the development roller 53 and the photoconductor drum 21 by the effect of a development (alternating) electric field formed between the development roller 53 and the photoconductor drum 21 at a development voltage including an alternating current fed to the sleeve 531. Thus, the developing device 5 develops an electrostatic latent image.

The developer 15 on the development roller 53 that has passed through the development operation area DE without being used for the development operation passes through the development opening 52 while being held on the outer peripheral surface of the sleeve 531 by the magnetic force and transported into the housing 50. Thereafter, the developer 15 is generally released from the sleeve 531 with the effect of the repelling magnetic polarity of the magnetic roller 532 and returned into the containing unit 51 (actually, the first transport path 51*a*). This released and returned developer is transported in the first transport path 51*a* while being agitated again by the agitation transporting member 55. The developer is circularly transported to be returned to the first transport path 51*a* through the second transport path 51*b* to be reused.

When the developing device 5 performs the above development operation, toner in the developer 15 inside the containing unit 51 decreases after being fed to the photoconductor drum 21 from the development roller 53 to be consumed. Thus, an additional amount of toner to compensate for the loss is fed to the containing unit 51 (second transport path 51*b*) from a removable toner container 18 through a feed device and a passage, not illustrated.

Detailed Structure of Developing Device

Figure 8A:
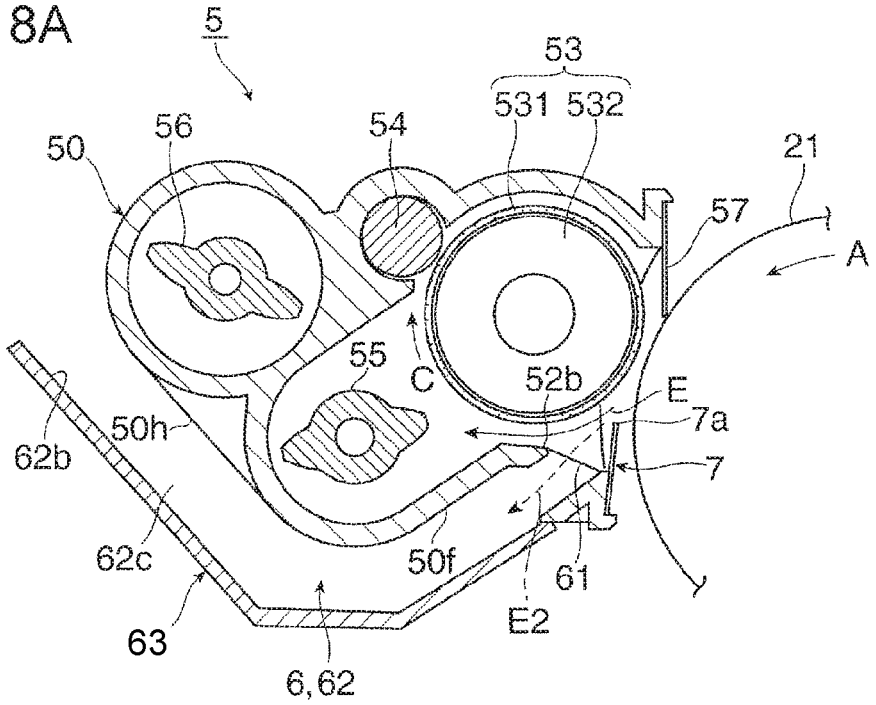
FIG. 8A is a sectional schematic view of the developing device in a state in a characteristic operation.

When the development roller 53 (sleeve 531) of the developing device 5 rotates, an airflow E, which flows substantially in the same direction as a rotational direction C of the development roller 53 (sleeve 531), occurs near the surface of the development roller 53 (sleeve 531) as indicated with a solid arrow in, for example, FIG. 8A.

Here, part of the airflow E flows through a gap between a downstream edge portion 52*b* of the development opening 52 and the development roller 53 inside the housing 50 (in the containing unit 51) in accordance with the rotation of the development roller 53.

Figure 8B:
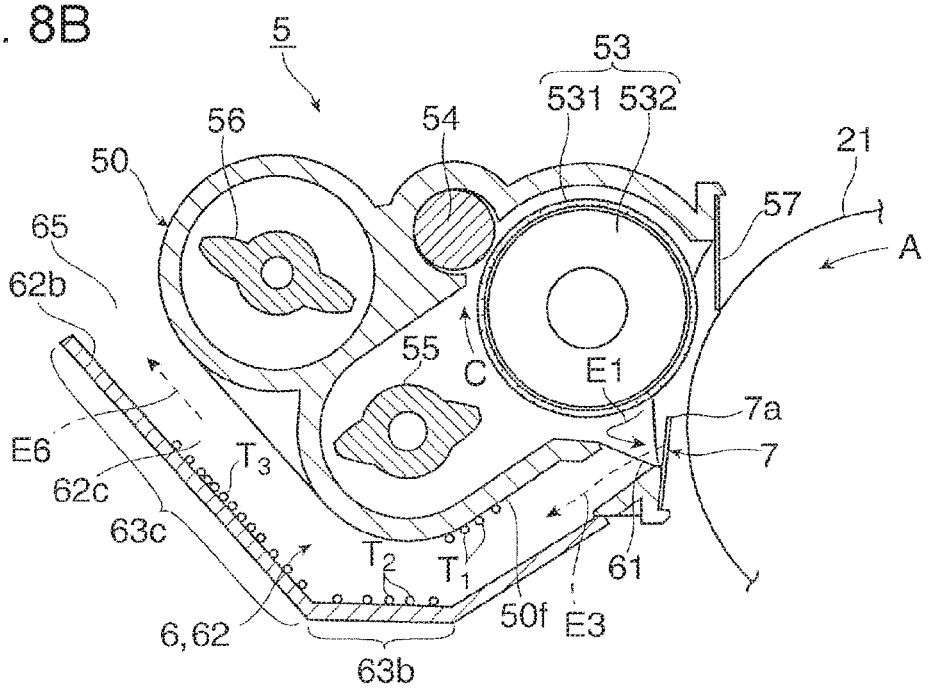
FIG. 8B is a sectional schematic view of the developing device in a subsequent state in the characteristic operation.

While the developing device 5 is in operation, the development roller 53 and the agitation transporting members 55 and 56 are rotating inside the housing 50, and the pressure inside the housing 50 (inner pressure) is higher than the atmospheric pressure outside the housing 50. Thus, part E1 of the airflow E is blocked by the pressure difference and flows so as to turn without flowing into the housing 50 as indicated with the solid arrow in FIG. 8B.

Thus, in the developing device 5, part of the developer 15 floats with the effect of the airflow E1 flowing in the return direction, and the floating developer is more likely to scatter to the outside of the housing 50 with the airflow E1.

Here, examples of part of the developer that floats with the effect of the airflow E1 include part of the developer (toner adhering to the carrier of the magnetic brush, in this example) that has been held on the sleeve 531 of the development roller 53 floating after being released immediately before inserted into the housing 50, and the developer (toner in this example) that remains adhering to a portion such as the downstream edge portion 52*b* of the development opening 52 without being returned to the inside of the housing 50 (containing unit 51).

Examples of the outside of the housing 50 to which the developer scatters include a gap between the developing device 5 and the opposing photoconductor drum 21, a gap between the developing device 5 and the exposure device 23, and a gap extending from the developing device 5 to the transfer device 25 along the photoconductor drum 21.

In order to prevent part of the developer (toner in this example) from scattering to the outside of the housing 50 by the airflow E1, as illustrated FIG. 2, FIG. 3, and other drawings, the developing device 5 includes inlet portions 61 of a flow path 6, and a guide member 7 at predetermined positions of the housing. The inlet portions 61 take in part of an airflow caused by a rotation of the development roller 53 and allow the airflow to flow over the outer surface of the housing 50. The guide member 7 guides part of the airflow to the inlet portions 61 of the flow path 6.

As illustrated in FIG. 3 and other drawings, the inlet portions 61 of the flow path 6 are located at a portion 50*b* of the housing 50 including the downstream edge portion 52*b*, downstream from the development opening 52 in the rotation direction C of the development roller 53.

Here, the flow path 6 takes in part of the airflow caused by a rotation of the development roller 53 and allows the airflow to flow over the outer surface of the housing 50. The intake airflow flows to any portion inside or outside the housing 10 of the image forming apparatus 1 that does not affect the image forming operation. The flow path 6 according to the first exemplary embodiment is a flow path having a length and a shape substantially following the outer surface of a lower portion of the housing 50.

The portion 50*b* of the housing 50 including the downstream edge portion 52*b* of the development opening 52 is a portion located further from the development roller 53 than is the downstream edge portion 52*b*. FIG. 3 and other drawings illustrate an upstream edge portion 52*a* of the development opening 52, disposed upstream in the rotation direction C of the development roller 53.

For example, the inlet portions 61 may be formed as part of the housing 50 concurrently with the flow path 6 during manufacturing of the housing 50.

As illustrated in FIG. 4, the inlet portions 61 of the flow path 6 are arranged side by side in the direction D of the shafts 531*a* and 531*b* corresponding to the rotation shafts of the development roller 53.

The inlet portions 61 according to the first exemplary embodiment are multiple thin rectangular openings 62 arranged in a line in the direction D of the rotation shafts while being spaced apart from each other with small gaps interposed therebetween in the direction D.

Figure 5A:
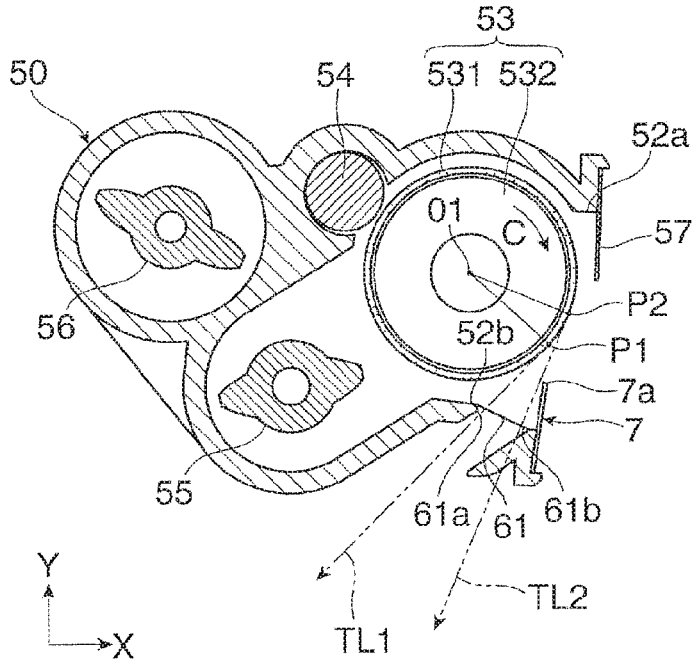
FIG. 5A is a schematic view of a structure of a flow path inlet portion of the developing device.

As illustrated in FIG. 5A, the inlet portions 61 of the flow path 6 are disposed to cross some (including TL1 and TL2) of a large number of tangents TL to the rotation direction C at the surface of the development roller 53 (sleeve 531).

The tangent TL1 illustrated in FIG. 5A as an example is a tangent that passes a point of contact P1 of the development roller 53 (sleeve 531), and crosses the inlet portions 61 near an end portion 61*a* closer to the downstream edge portion 52*b* of the development opening 52. The tangent TL2 illustrated in FIG. 5A as an example is a tangent that passes a point of contact P2 of the development roller 53 (sleeve 531), and crosses the inlet portions 61 near an end portion 61*b* further from the downstream edge portion 52*b* of the development opening 52. Particularly, the tangent TL2 illustrated in FIG. 5A as an example is a tangent that touches an end portion 7*a* of the guide member 7 closer to the development roller 53.

Thus, the inlet portions 61 according to the first exemplary embodiment cross a large number of tangents TL between at least the two tangents TL1 and TL2 and multiple tangents located outside of the two tangents TL1 and TL2.

Figure 5B:
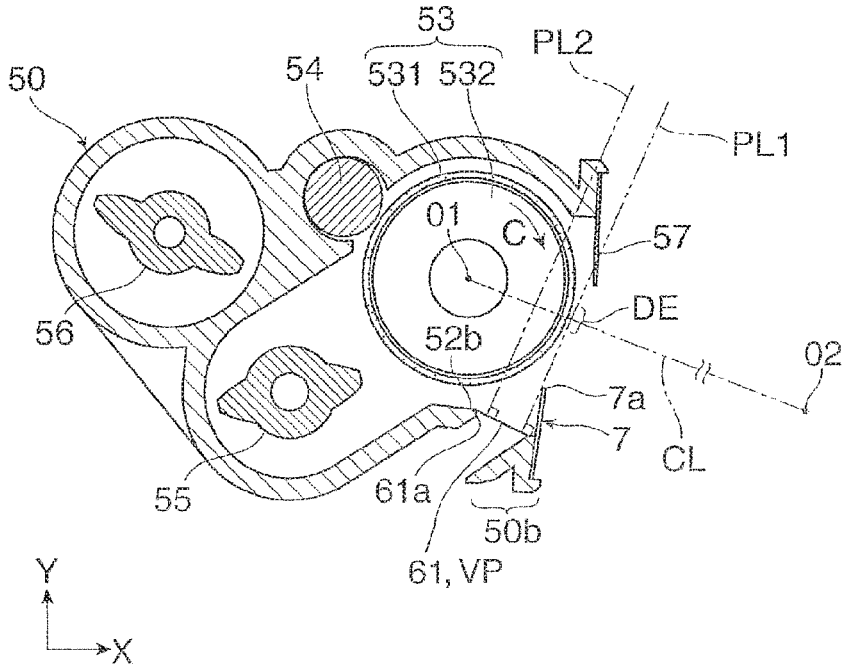
FIG. 5B is a schematic view of another structure of a flow path inlet portion of the developing device.

As illustrated in FIG. 5B, the inlet portions 61 of the flow path 6 according to the first exemplary embodiment are disposed so that some (including PL1 and PL2) of a large number of perpendiculars PL to a virtual plane VP that covers the openings of the inlet portions 61 extend over the surface portion DE of the development roller 53 (sleeve 531), serving as a development operation area, or extend through the development roller 53 on the inner side of the surface portion DE (through the sleeve 531 or magnetic roller 532).

The perpendicular PL1 illustrated in FIG. 5B as an example is a perpendicular extending over the surface portion DE of the development roller 53 (sleeve 531) serving as a development operation area. Particularly, the perpendicular PL1 illustrated in FIG. 5B as an example is a perpendicular extending in contact with the end portion 7*a* of the guide member 7 closer to the development roller 53.

The perpendicular PL2 illustrated in FIG. 5B as an example is a perpendicular extending through the development roller 53 (sleeve 531) on the inner side of the surface portion DE of the development roller 53 (sleeve 531), serving as a development operation area. The perpendicular PL2 is a perpendicular extending near the end portion 61*a* of the inlet portion 61 (plane VP) closer to the downstream edge portion 52*b* of the development opening 52.

The inlet portions 61 according to the first exemplary embodiment are inlet portions (or openings) that face the development roller 53 to a greater degree than the photoconductor drum 21, since the number of perpendiculars PL2 extending through the development roller 53 on the inner side of the surface portion DE of the development roller 53, serving as the development operation area, is particularly greater than the number of perpendiculars PL1 extending over the surface portion DE, serving as the development operation area.

Figure 6:
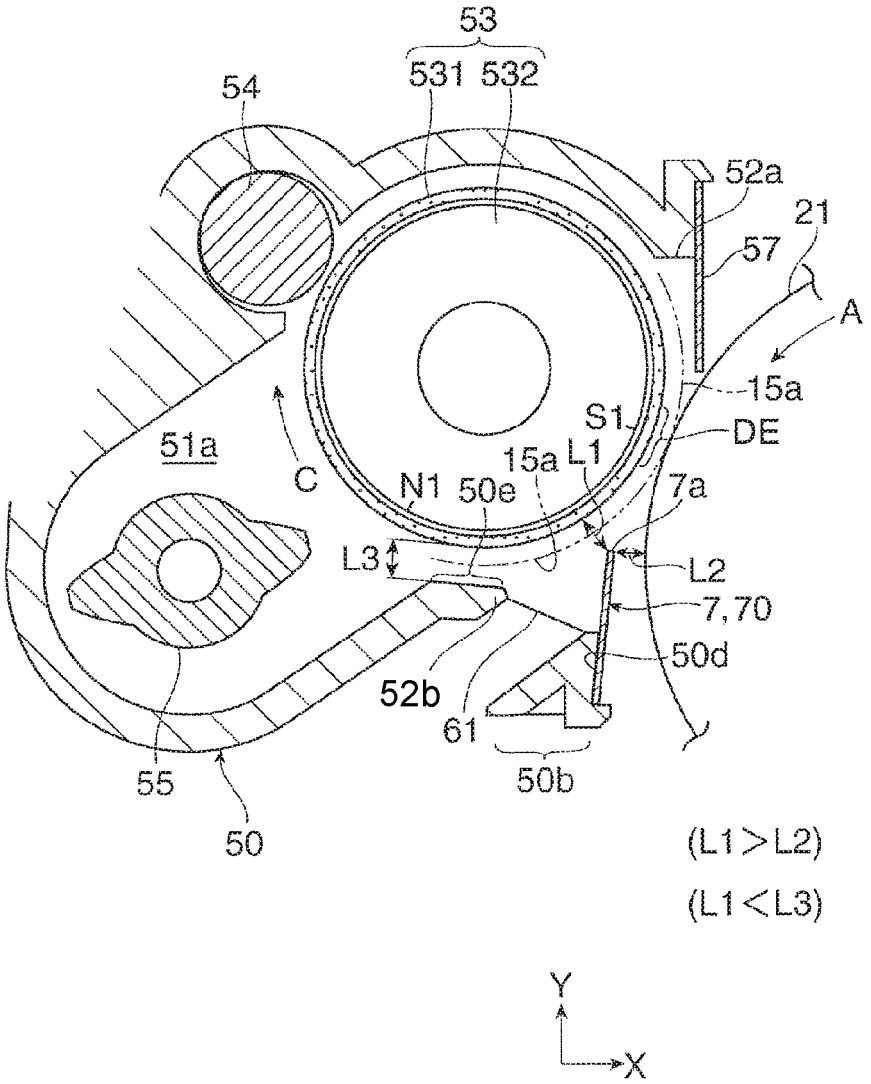
FIG. 6 is a sectional schematic view of a structure of a portion of the developing device including the guide member.

As illustrated in FIG. 3, FIG. 6, and other drawings, the guide member 7 extends toward the development roller 53 from a portion 50*d* of the housing 50, which is on the side of the inlet portions 61 of the flow path 6 opposite to the development opening 52.

The portion 50*d* of the housing 50 on the side of the inlet portions 61 opposite to the development opening 52 extends in the direction D of the rotation shafts of the development roller 53 from end portions 61*b* of the inlet portions 61 further from the downstream edge portion 52*b* of the development opening 52, and forms substantially smooth surface extending in the opposite direction from the end portions 61*b*. The above portion 50*d* of the housing 50 according to the first exemplary embodiment has a surface having an angle adjusted to an attachment angle of the guide member 7, having a substantially flat shape.

The guide member 7 according to the first exemplary embodiment includes a film member 70 formed into a thin rectangular flat shape from a synthetic resin film (sheet) made of a material such as polyethylene terephthalate (PET). The guide member 7 including the film member 70 includes a portion having the end portion 7*a*, which is a free end of the film member 70. The portion having the end portion 7*a* scarcely ever moves with a contact of an airflow caused by, for example, a rotation of the development roller 53. The guide member 7 including the film member 70 has, for example, a portion closer to an end portion 7*b* (proximal end portion) further from the development roller 53 fixed by being attached to the portion 50*d* of the housing 50 by a fastening method, such as bonding.

As illustrated in FIG. 6, the end portion (free end) 7*a* of the guide member 7 to the development roller 53 is not in contact with the developer 15 (magnetic brush) held on the surface of the development roller 53 (sleeve 531). FIG. 6 illustrates a top layer (outermost) portion 15*a* of the magnetic brush of the developer held on the surface of the development roller 53.

As illustrated in FIG. 6, the end portion 7*a* of the guide member 7 according to the first exemplary embodiment closer to the development roller 53 is located closer to the photoconductor drum 21 than is the development roller 53, the photoconductor drum 21 being an example of an image carrier that holds an electrostatic latent image that is to be developed.

In other words, the guide member 7 here is disposed to satisfy the relationship L1>L2, where a shortest distance L1 between its end portion (free end) 7*a* and the development roller 53 is longer than a shortest distance L2 between the end portion 7*a* and the photoconductor drum 21.

As illustrated in FIG. 6, the end portion 7*a* of the guide member 7 according to the first exemplary embodiment closer to the development roller 53 is located closer to the development roller 53 than is a chin 50*e* of the housing 50, extending along the peripheral surface of the development roller 53 (sleeve 531).

In other words, the guide member 7 here is disposed to satisfy the relationship L1>L3, where the shortest distance L1 between its end portion (free end) 7*a* and the development roller 53 is shorter than a shortest distance L3 between the chin 50*e* of the housing 50 and the development roller 53.

The chin 50*e* of the housing 50 is a portion having an arc-shaped cross section taken substantially along (the curvature of) the cylindrical peripheral surface of the cylindrical sleeve 531 and having a strip shape extending in the direction D of the rotation shafts (shafts) of the sleeve 531.

As illustrated in FIG. 6 or FIG. 7, in the magnetic roller 532 of the development roller 53 of the developing device 5, the magnetic polarity N1, located next to the development magnetic polarity S1 in the rotation direction C of the sleeve 531 is located downstream of the chin 50*e*, extending along the peripheral surface of the cylindrical sleeve 531 of the housing 50, in the rotation direction C of the sleeve 531.

In the first exemplary embodiment, the magnetic polarity N1 located next to the development magnetic polarity S1 serves as a release magnetic polarity. The release magnetic polarity N1 is spaced by a predetermined distance apart downstream in the rotation direction C from a position MP (FIG. 7) of the magnetic roller 532, opposing a downstream end portion of the chin 50*e* of the housing 50 in the rotation direction C of the sleeve 531. Here, the release magnetic polarity N1 is located so that the magnetic force line pattern in the normal direction caused by the magnetic polarity N1 has a peak point located within a containing unit 51 (first transport path 51*a*) beyond the chin 50*e* of the housing 50.

In the developing device 5, the flow path 6 serves as an airflow processing path 62, which allows an airflow guided by the guide member 7 and taken in from the inlet portions 61 to flow therethrough and captures the developer 15 (actually, toner) that moves on the airflow.

As illustrated in FIG. 3 and FIG. 7, the airflow processing path 62 according to the first exemplary embodiment includes a passage member 63, which covers the outer surface of the lower portion (bottom) of the housing 50 at a predetermined distance apart from the outer surface of the lower portion.

The passage member 63 extends substantially along the outer surface of the lower portion of the housing 50 from the portion 50*b* of the housing 50 including the inlet portions 61 to a portion 50*i* of the housing 50, opposite to the inlet portions 61. The passage member 63 defines the flow path (space) 6, serving as the airflow processing path 62, between itself and the outer surface of the lower portion of the housing 50. The passage member 63 is a member made of a material the same as or different from the material for the housing 50.

Specifically, the passage member 63 according to the first exemplary embodiment includes a first surface portion 63*a*, facing a downwardly inclined portion 50*f* that extends obliquely downward in a flat shape from the chin 50*e* of the housing 50, a second surface portion 63*b*, facing a cylindrical surface portion at the lowermost portion of the housing 50, and a third surface portion 63*c*, facing an upwardly inclined portion 50*h* extending obliquely upward in a flat or curved shape from the lowermost portion of the housing 50. The passage member 63 also includes side wall portions, which are not illustrated and which cover the side portions between the passage member 63 and the housing 50, at both end portions in the longitudinal direction of the housing 50 (the direction D of the rotation shafts). A terminal portion 65 of the airflow processing path 62 (the flow path 6) is left open. The second surface portion 63*b* of the passage member 63 is located closer to the feed transport path Rt1 (actually, for example, a sheet guide member) for the recording sheet 9 located below the second surface portion 63*b*, and is thus so located or has such a shape as not to interfere with the feed transport path Rt1.

As illustrated in FIG. 7, the airflow processing path 62 according to the first exemplary embodiment includes a passage portion 62*c*, which includes an upwardly inclined slope 62*b* extending from bottom to top in the gravitational direction G.

The upwardly inclined slope 62*b* has a function of decelerating the air that is taken in from the inlet portions 61 and that comes into contact with the upwardly inclined slope 62*b*. The characteristics of the upwardly inclined slope 62*b* such as an angle of inclination are appropriately determined. Preferably, the upwardly inclined slope 62*b* has its terminal portion (uppermost end portion) located higher than the inlet portions 61 in the gravitational direction G. In the first exemplary embodiment, the third surface portion 63*c* and the inner surface portion of the passage member 63 form the passage portion 62*c* including the upwardly inclined slope 62*b*.

As illustrated in FIG. 7, the airflow processing path 62 according to the first exemplary embodiment has its height h gradually rising toward the downstream side in the direction of an airflow.

The airflow processing path 62 illustrated in FIG. 7 as an example has heights h1 to h5, at points from the inlet portions 61 to the terminal portion 65, which satisfy the relationship $h1<h2<h3<h4\leq h5$. The height h1 is a height at the flow path closest to the inlet portions 61. The height h2 is a height of the passage portion between the downwardly inclined portion 50*f* of the housing 50 and the first surface portion 63*a* of the passage member 63. The height h3 is a height of the passage portion between a lowermost portion 50*g* of the housing 50 and the second surface portion 63*b* of the passage member 63. The height h4 is a height of the passage portion between the lower end portion of the upwardly inclined portion 50*h* of the housing 50 and the third surface portion 63*c* of the passage member 63. The height h5 is a height of the passage portion between the upper end portion of the upwardly inclined portion 50*h* of the housing 50 and the third surface portion 63*c* of the passage member 63.

The airflow processing path 62 has a substantially uniform width.

Detailed Operation of Developing Device

As described above, while in operation, the developing device 5 causes an airflow E that flows in the direction substantially the same as the rotation direction C of the rotating development roller 53 (sleeve 531) near the surface of the development roller 53 (FIG. 8A).

Here, as indicated with dotted arrow in FIG. 8A as an example, part E2 of the airflow E may flow into the inlet portions 61 of the flow path 6 that are open near the downstream edge portion 52*b* of the development opening 52 of the housing 50.

Like this part E2 of the airflow, an airflow that directly flows into the inlet portions 61 of the flow path 6 carries floating toner caused by the effect of the airflow E1, which flows so as to turn as described below, to the inlet portions 61 of the flow path 6 on the part E2 of an airflow.

On the other hand, a large amount (part E1) of the airflow E flows so as to turn without flowing into the housing 50 (FIG. 8B), as described above, and the developer (actually, toner) floating in the airflow E1 flowing in the return direction may be discharged to the outside of the housing 50.

On the other hand, the developing device 5 includes the guide member 7 besides the inlet portions 61 of the flow path 6. Thus, the airflow E1 that flows so as to turn without flowing into the housing 50 comes into contact with the guide member 7 and is guided to flow into the inlet portions 61 of the flow path 6, as indicated with dotted arrow in FIG. 8B. Specifically, in the developing device 5, the airflow E1 that flows so as to turn flows in the form of the airflow E3 that is guided by the guide member 7 to flow into the inlet portions 61 of the flow path 6.

Here, the above-described airflow E2 that directly flows into the inlet portions 61 is also located in the area surrounded by the guide member 7, the development roller 53, and inlet portions 61. Thus, the airflow E1 is prevented from flowing through the gap between the guide member 7 and the development roller 53 into the gap between the developing device 5 and the photoconductor drum 21, which is an example of the outside of the housing 50.

A portion of the guide member 7 including the end portion 7*a* serving as its free end does not move with a contact of the airflow E caused by a rotation of the development roller 53 or the airflow E1 that flows so as to turn.

The developing device 5 is thus capable of preventing part of the developer (actually, toner) caused to float by the airflow E1, which flows so as to turn without flowing into the housing 50, from being dispersed to the outside (for example, a gap between the developing device 5 and the photoconductor drum 21) of the housing 50 on the airflow E1.

In the developing device 5, the inlet portions 61 of the flow path 6 are disposed to have their openings crossing some (such as TL1 and TL2) of a large number of tangents TL to the rotation direction C at the surface of the development roller 53 (FIG. 5A). Thus, particularly, the part (airflow E2) of the airflow E that flows almost along the tangents (such as TL1 and TL2) crossing the inlet portions 61 and that flows without touching the guide member 7 is capable of easily flowing into the inlet portions 61, and the floating developer is more easily prevented from being dispersed to the outside of the housing 50.

The inlet portions 61 of the flow path 6 are arranged in the direction D of the rotation shafts of the development roller 53 (FIG. 4). Thus, the part E2 of the airflow E1 that occurs in the area extending along the direction D of the rotation shafts of the development roller 53 is evenly taken into the inlet portions 61 of the flow path in the direction D of the rotation shafts.

In the developing device 5, the inlet portions 61 of the flow path 6 are disposed so that some (such as PL1 and PL2) of a large number of perpendiculars PL to the virtual plane VP, covering the openings of the inlet portions 61, extend over the surface portion DE of the development roller 53, serving as the development operation area, or extend through the development roller 53 on the inner side of the surface portion DE (FIG. 5B). Thus, the part E3 of the airflow E easily directly flows into the inlet portions 61. As described below, an airflow E3 that flows by being guided by the guide member 7 also easily flows into the inlet portions 61.

Figure 12:
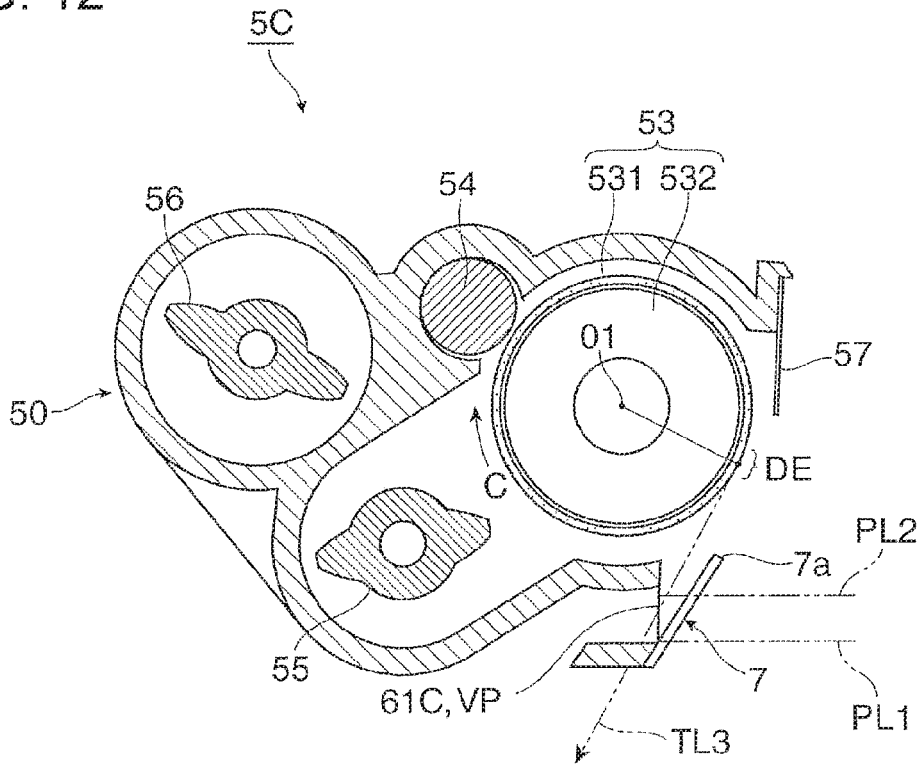
FIG. 12 is a sectional schematic view of another example of the flow path inlet portion in the developing device.

Alternatively, a developing device 5C, which is illustrated in FIG. 12 as an example and includes inlet portions 61C instead of the inlet portions 61 of the flow path 6, may be formed. The inlet portions 61C have their openings crossing some (including TL3) of a large number of tangents TL to the rotation direction C at the surface of the development roller 53, and some (including PL1 and PL2) of a large number of perpendiculars PL to the virtual plane VP that covers the openings do not extend neither over the surface portion DE of the development roller 53, serving as a development operation area, nor through the development roller 53 on the inner side of the surface portion DE.

When the developing device 5C is compared with the developing device 5, the part E3 of the airflow E (FIG. 8B) is more likely to fail to directly flow into the inlet portions 61C of the flow path 6.

In the developing device 5, the end portion 7*a* of the guide member 7 closer to the development roller 53 is located closer to the photoconductor drum 21 than is the development roller 53 (FIG. 6). This structure more easily allows the airflow E1 that flows so as to turn to be guided toward the inlet portions 61 of the flow path 6 using the guide member 7, and prevents part of the developer from being discharged to the outside of the housing 50 by the airflow guided to the inlet portions 61. In the developing device 5, the end portion 7*a*, which is a free end, of the guide member 7 is located close to the photoconductor drum 21. This structure increases the gap between the end portion 7*a* and the development roller 53, and is thus capable of increasing the airflow E2 (FIG. 8A) that flows directly toward the inlet portions 61 of the flow path 6, of the airflow caused by the rotation of the development roller 53.

Figure 11:
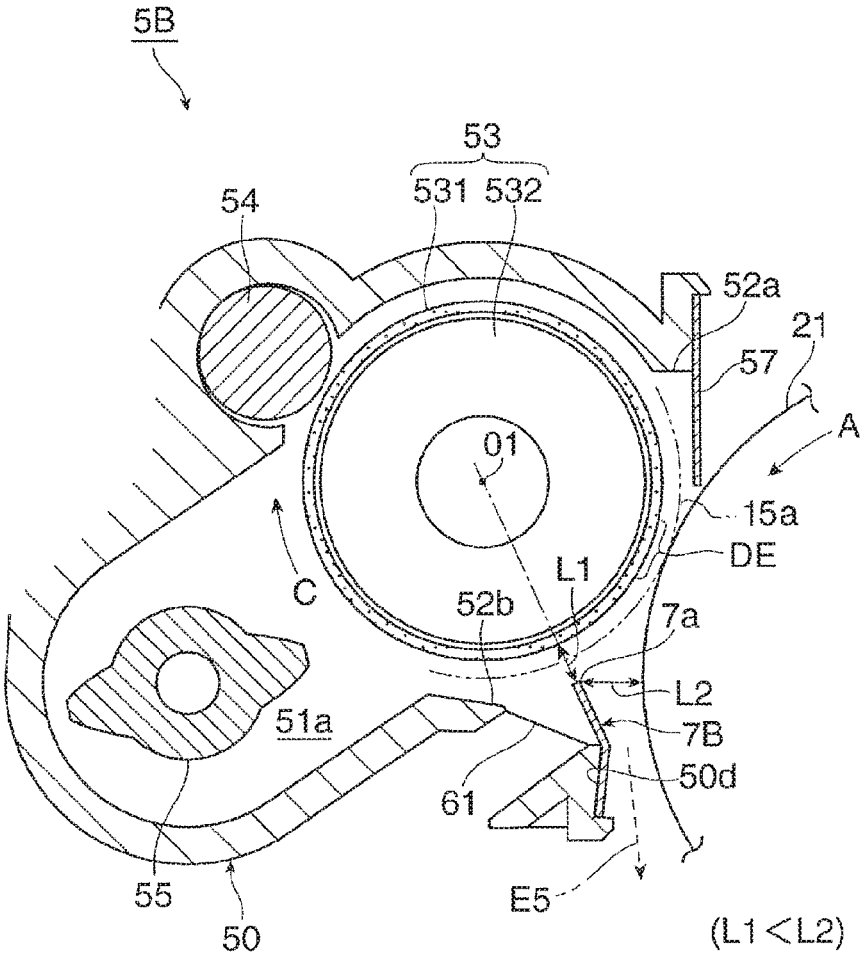
FIG. 11 is a sectional schematic view of another example of the guide member in the developing device.

Instead of the guide member 7, a developing device 5B including a guide member 7B as illustrated in FIG. 11 is also possible. The guide member 7B includes an end portion 7*a*, closer to the development roller 53, located closer to the development roller 53 than is the photoconductor drum 21.

Specifically, this guide member 7B satisfies the relationship L1<L2, where the shortest distance L1 between its end portion (free end) 7*a* and the development roller 53 is shorter than the shortest distance L2 between the end portion 7*a* and the photoconductor drum 21. The end portion (free end) 7*a* of the guide member 7B is a flat plate member oriented toward the rotation center 01 of the development roller 53.

Similarly to the case of the developing device 5, in the developing device 5B, the guide member 7B is capable of efficiently guiding the airflow E1 that flows so as to turn and capable of taking the airflow E1 into the inlet portions 61 of the flow path 6.

On the other hand, compared to the developing device 5, the developing device 5B has a greater gap between the end portion 7*a* of the guide member 7B, which is a free end, and the photoconductor drum 21. This structure hinders an increase of the airflow E2 (FIG. 8A) that directly flows into the inlet portions 61 of the flow path 6, of the airflow E caused by the rotation of the development roller 53, and the guide member 7B may cause an airflow E5 that flows toward a gap between the developing device 5B and the photoconductor drum 21. When, for example, a developer that floats in the airflow E1 that flows so as to turn is delivered to a portion near the gap between the guide member 7B and the development roller 53, the developer may be discharged outside of the housing 50 by the airflow E5.

In the developing device 5, the end portion 7*a* of the guide member 7 closer to the development roller 53 is located closer to the development roller 53 than is the chin 50*e* of the housing 50 (FIG. 6). This structure also allows the airflow E1 that flows so as to turn to come into contact with the guide member 7 and to be easily guided toward the inlet portions 61 of the flow path 6, and prevents the developer that is caused to float by the airflow E1 from being directly discharged to the outside of the housing 50.

In the magnetic roller 532 of the development roller 53 in the developing device 5, the magnetic polarity N1 immediately next to the development magnetic polarity S1 in the rotation direction C of the sleeve 531 is located at a position downstream from the chin 50*e* of the housing 50 in the rotation direction C of the sleeve 531 (FIG. 6 or FIG. 7). Thus, the developer 15 contained in the development roller 53 receives the effect of a magnetic force from the release magnetic polarity N1 of the magnetic roller 532 at a portion on the inner side (containing unit 51) of the chin 50*e* of the housing 50, and comes off the development roller 53 to float. The floating developer (toner) is thus prevented from being discharged to the outside of the housing 50 on the airflow E1 that flows so as to turn and that is caused at a portion upstream of the chin 50*e* in the rotation direction C of the sleeve 531.

Figure 13:
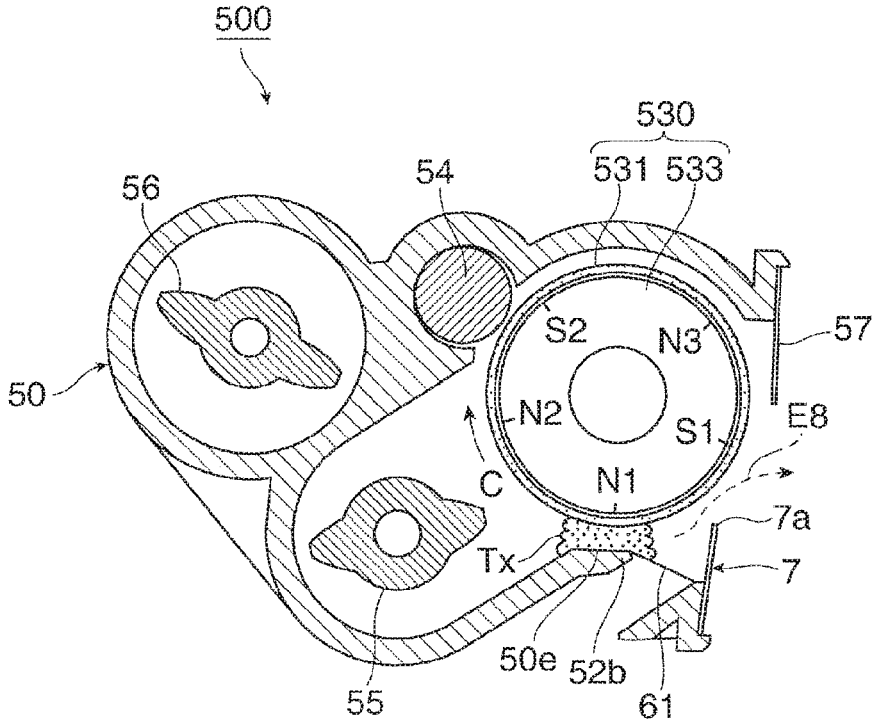
FIG. 13 is a schematic view of a developing device according to a comparative example having a different magnetic polarity arrangement.

A developing device 500 according to a comparative example that includes a development roller 530, as illustrated in FIG. 13 as an example, instead of the development roller 53 of the developing device 5 may have the following problem. The development roller 530 includes a magnetic roller 533 as a magnetic roller. The magnetic roller 533 has a magnetic polarity N1, located next to the development magnetic polarity S1 in the rotation direction C of the sleeve 531, located so as to face the chin 50*e* of the housing 50.

Specifically, in the developing device 500 according to the comparative example, the developer 15 held on the development roller 530 receives the effect of the magnetic force of the release magnetic polarity N1 of the magnetic roller 533 around the position at which it faces the chin 50*e* of the housing 50, and comes off the development roller 530 to start floating. FIG. 13 illustrates floating toner Tx.

When the floating developer (toner Tx) is carried on the airflow E1 that flows so as to turn and that is caused at a portion upstream of the chin 50*e* in the rotation direction C of the sleeve 531, part of the developer may be discharged to the outside of the housing 50 through the gap between the guide member 7 and the development roller 530 without being guided into the inlet portions 61 of the flow path 6.

In this case, a relatively large amount of toner Tx that floats after coming off the development roller 530 occurs also at the downstream edge portion 52*b* of the development opening 52 of the housing 50. Thus, even with the existence of the guide member 7, part of the floating toner Tx that is not guided by the guide member 7 flows to the outside on an airflow E8 flowing through the gap between the guide member 7 and the development roller 530.

In the developing device 5, the airflows E2 and E3 taken into the inlet portions 61 of the flow path 6 flow naturally only with the effect of the airflow inside the flow path 6, serving as the airflow processing path 62.

At this time, the airflows E2 and E3 move while coming into contact with the inner wall surfaces defining the airflow processing path 62 (the lower outer surface of the housing 50 and the inner surface of the passage member 63). Thus, when the floating toner T is carried on the airflows E2 and E3, the floating toner T adheres to and is captured by the inner wall surfaces defining the airflow processing path 62.

Examples of the captured floating toner include floating toner $T_1$, which adheres to and is captured by the downwardly inclined portion 50*f* at a lower portion of the housing 50, floating toner $T_2$, which adheres to and is captured by the horizontal inner surface of the second surface portion 63*b* of the passage member 63, and floating toner $T_3$, which adheres to and is captured by the upwardly inclined slope 62*b* of the third surface portion 63*c* of the passage member 63.

The airflows E2 and E3 that have flowed into the airflow processing path 62 naturally disappear with the decrease of the speed of the airflows as they move a longer distance.

The airflow processing path 62 according to the first exemplary embodiment includes a passage portion 62*c* including the upwardly inclined slope 62*b* at its downstream portion. The airflows E2 and E3 are more likely to lose their speed as a result of coming into contact with the upwardly inclined slope 62*b* of the passage portion 62*c*. Thus, the floating toner T that moves inside the airflow processing path 62 on the airflows E2 and E3 is more likely to come into contact with and adhere to the upwardly inclined slope 62*b*, and finally to be captured as the floating toner $T_3$.

The airflows E2 and E3 that have flowed into the airflow processing path 62 naturally disappear while flowing through the passage portion 62*c* having the upwardly inclined slope 62*b* or form into a weak airflow E6 that does not contain the floating toner T, and are then discharged to the outside from the open terminal portion 65 of the airflow processing path 62.

In the developing device 5, the airflow processing path 62 has its height h rising toward the downstream side in the direction in which the airflow flows (FIG. 7).

Compared to a developing device including an airflow processing path 62 having its height h tapering toward the downstream side in the direction in which the airflow flows, the developing device 5 enables part of the airflow caused by the rotation of the development roller 53 to be easily taken into and easily dispersed in the airflow processing path 62, and to flow more smoothly.

Thus, the developer (actually, toner T) caused to float due to the airflow E1 that flows so as to turn near the downstream edge portion 52*b* of the development opening 52 of the housing 50 is more easily carried by the airflow E3 (FIG. 8B) taken into the airflow processing path 62, and more efficiently captured in the airflow processing path 62.

Test

Figure 9:
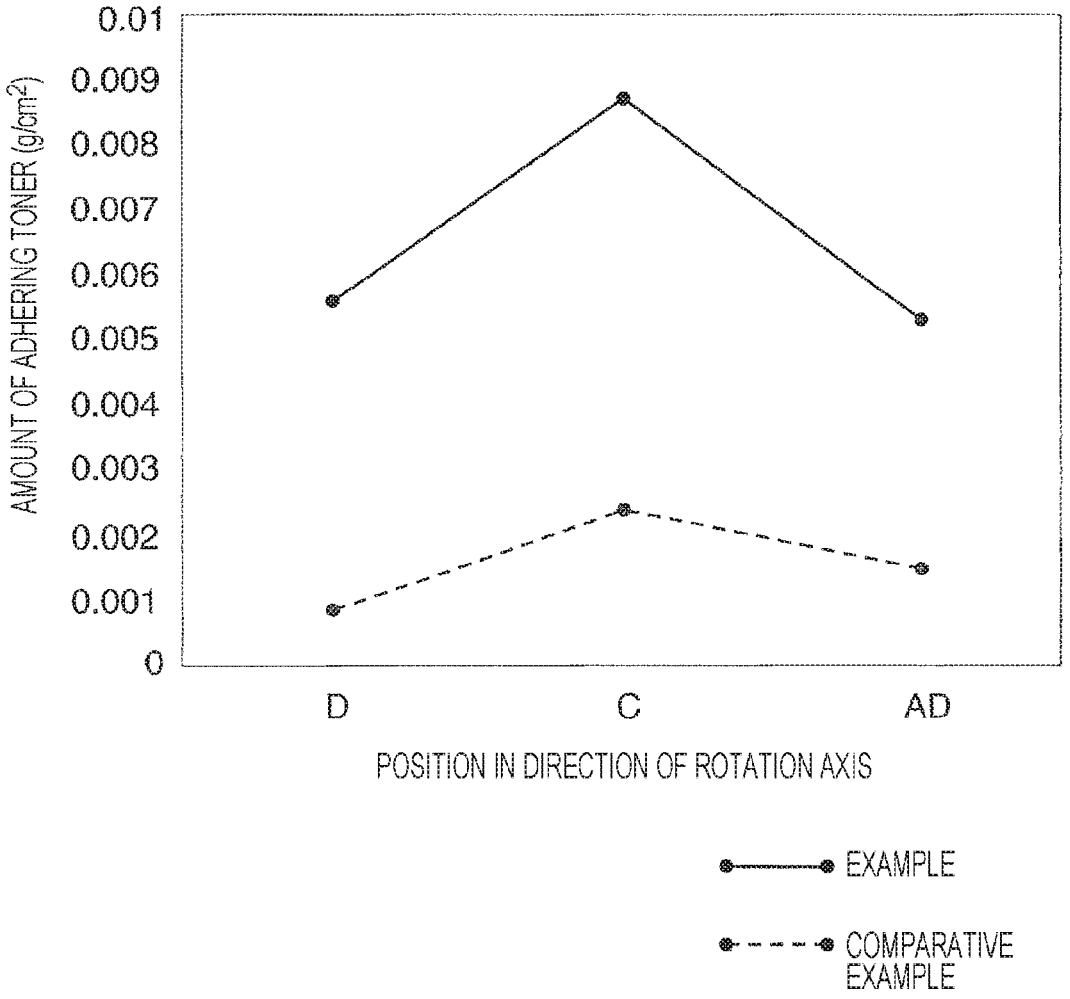
FIG. 9 is a graph showing test results.

FIG. 9 illustrates the test results conducted using the image forming apparatus 1 including the developing device 5.

The test is conducted to measure the amount of toner adhering to the downwardly inclined portion 50*f* (FIG. 7 and FIG. 8) at a lower portion of the housing 50 after the image forming apparatus 1 performs predetermined image forming operations (including a development operation performed by the developing device 5) under the same conditions except for the inlet portions 61 of the flow path 6 in the developing device 5 being open (as in the example) and closed (in the comparative example).

The amount of toner adhering to the downwardly inclined portion 50*f* at the lower portion of the housing 50 is measured at three portions including a portion corresponding to an end portion of the development roller 53 to which the driving gear 537 is attached (driving end portion D), a portion corresponding to the opposite end portion of the development roller 53 and having a predetermined width (nondriving end portion AD), and a portion corresponding to a middle portion between the end portions of the development roller 53 and having a predetermined width (middle portion C). These three portions are defined to have the same area.

In this test, an image forming operation is performed using the developing device 5 in which the passage member 63 includes the airflow processing path 62. The amount of adhering toner is measured after the airflow processing path 62 (passage member 63) is removed from the developing device 5.

The results in FIG. 9 reveal that a relatively large amount of toner adheres to all the three portions when the flow path 6 of the developing device 5 has the open inlet portions 61 (in this example), and that the airflow processing path 62 effectively functions in capturing the floating toner.

When, on the other hand, the developing device 5 has closed inlet portions 61 (in the comparative example), the results in FIG. 9 reveal that scarcely any toner adheres to the three portions, unlike in the example. This is probably because, for example, the amount of toner that has adhered in the example has been dispersed through the gap between the developing device 5 and the photoconductor drum 21. In an actual observation after the test of the comparative example, toner has adhered to portions including a sheet guide member of the sheet transport path located between the developing device 5 and the photoconductor drum 21.

Figure 10:
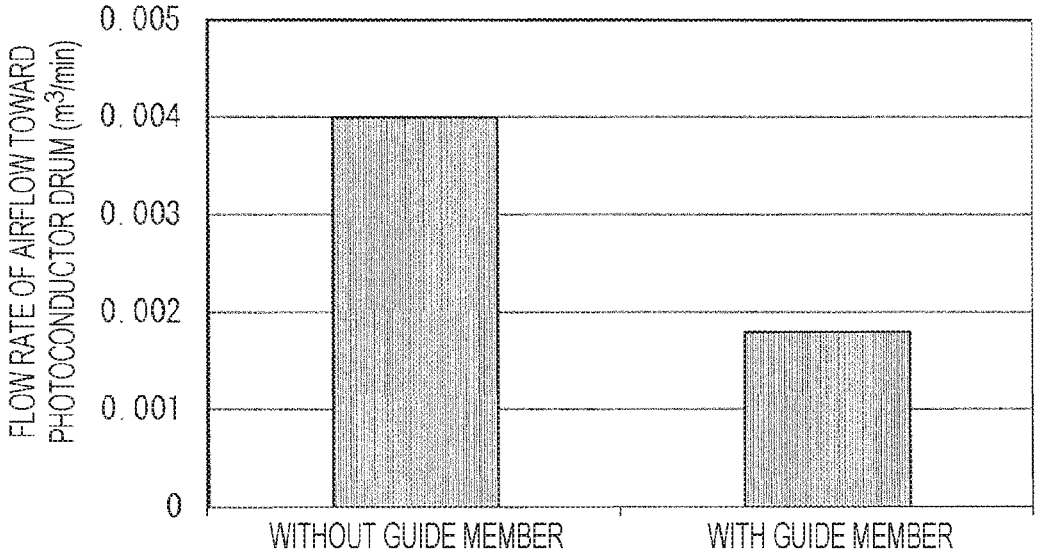
FIG. 10 is a graph showing additional measurement results.

FIG. 10 shows the measurement results additionally measured in the image forming apparatus 1 including the developing device 5 used in the above test.

This additional measurement is obtained through simulations conducted using two types of the developing devices 5 including and not including the guide member 7 to measure the airflow around the surface of the photoconductor drum 21 at a point beyond the developing devices 5. This measurement has been conducted under the conditions where the photoconductor drum 21 and the development roller 53 (sleeve 531) are rotated at speeds the same as the operation speeds in the image forming operation.

The results in FIG. 10 reveal that the flow rate of the airflow flowing toward the surface of the photoconductor drum 21 decreases in the developing device 5 including the guide member 7, compared to the case of the developing devices 5 not including the guide member 7.

Other Exemplary Embodiments

The first exemplary embodiment illustrates a structure (in FIG. 4) including multiple inlet portions 61 of the flow path 6 arranged in a line in the direction D of the rotation shafts of the development roller 53, but this structure is not the only possible structure. For example, a single continuous thin rectangular opening may be used instead of the inlet portions 61. Instead, the inlet portion may have one or more rows of circular or oval openings.

The first exemplary embodiment illustrates a structure (in FIG. 3) including a film member 70 serving as the guide member 7. Any member made of any material and capable of guiding the airflow without blocking the development operation may be used as the guide member 7. However, the guide member 7 is preferably a member having such sufficient stiffness as not to scarcely ever move when touched with the airflow E caused by a rotation of the development roller 53 or the airflow E1 that flows so as to turn.

The first exemplary embodiment illustrates a structure (in FIG. 7) including the airflow processing path 62 having its passage height h rising to the downstream side in the direction in which the airflow flows. Other examples of the airflow processing path 62 may include a structure having its passage height h remaining unchanged on the downstream side in the direction in which the airflow flows. However, in order for, for example, the airflow taken in through the inlet portions 61 to smoothly flow to the downstream side, the airflow processing path 62 preferably has a passage height h rising toward the downstream side in the direction in which the airflow flows.

The airflow processing path 62 may include, at the terminal portion 65, a filter member that captures and recovers toner. However, a filter member that may hinder the airflow from naturally flowing into the airflow processing path 62 (by its force) is not preferably disposed.

The airflow processing path 62 may include an intake system at the terminal portion 65 or at the terminal portion of a connection air pipe connected to the terminal portion 65 so that the airflow processing path 62 has a suction effect inside itself.

The first exemplary embodiment illustrates the image forming apparatus 1 that forms single-color images using one developing device 5. However, the image forming apparatus may include multiple developing devices 5 to form multi-color images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a housing including a development opening and a containing unit configured to contain a developer;

a developer carrier configured to rotate to pass through the development opening while holding the developer in the containing unit of the housing;

an inlet portion of a flow path located in the housing at a portion including a downstream edge portion of the development opening on a downstream side in a rotation direction of the developer carrier, the inlet portion being configured to take in part of an airflow caused by a rotation of the developer carrier to allow the part of the airflow to flow over an outer surface of the housing; and a guide member extending toward the developer carrier from a portion of the housing on a side of the inlet portion opposite to the development opening, wherein the guide member is configured to guide the part of the airflow to the inlet portion, wherein an end portion of the guide member closest to the developer carrier is not in contact with a developer held on the developer carrier, wherein the end portion of the guide member closest to the developer carrier is located closer to the developer carrier than is a chin of the housing, the chin having a shape following an outer peripheral surface of the developer carrier, wherein the inlet portion and the guide member are configured to prevent the airflow from flowing outside the developing device, and wherein an image carrier is located closer to the end portion of the guide member closest to the developer carrier than is the developer carrier.

2. The developing device according to claim 1, wherein the inlet portion extends in a direction of a rotation shaft of the developer carrier and crosses at least one of tangents to a rotation direction of the developer carrier at a surface of the developer carrier.

3. The developing device according to claim 2, wherein the inlet portion is disposed so that a perpendicular to a plane covering the inlet portion extends over a surface portion of the developer carrier, serving as a development operation area, or extends through the developer carrier on an inner side of the surface portion.

4. The developing device according to claim 1, wherein the developer carrier includes a rotatable cylindrical member and a magnetic member including a plurality of magnetic polarities arranged inside the cylindrical member, and wherein the magnetic member has a magnetic polarity next to a development magnetic polarity in a rotation direction of the cylindrical member, and the magnetic polarity is located downstream from the chin of the housing in the rotation direction of the cylindrical member, the chin having a shape following a peripheral surface of the cylindrical member.

5. The developing device according to claim 1, wherein the flow path is configured to serve as an airflow processing path that allows an airflow guided by the guide member and taken in through the inlet portion to flow therethrough, and wherein the flow path is configured to capture a developer that moves on the airflow.

6. The developing device according to claim 5, wherein the airflow processing path includes a passage portion including an upwardly inclined slope extending from bottom to top in a gravitational direction.

7. The developing device according to claim 6, wherein the upwardly inclined slope comprises a surface portion facing an upwardly inclined portion of the housing, and wherein the upwardly inclined portion of the housing extends obliquely upward in a flat or curved shape from a lowermost portion of the housing.

8. The developing device according to claim 7, further comprising a first agitation transporting member and a second agitation transporting member, wherein the first agitation transporting member is farther away from the developer carrier than the second agitation transporting member, wherein the first agitation transporting member is higher than the second agitation transporting member in the gravitational direction, and wherein the upwardly inclined portion of the housing faces the first agitation transporting member and the second agitation transporting member.

9. The developing device according to claim 5, wherein the airflow processing path has a height rising toward or remaining unchanged on a downstream side in a direction in which the airflow flows.

10. The developing device according to claim 1, wherein the image carrier is configured to hold an electrostatic latent image that is to be developed.

11. An image forming apparatus, comprising:

an image carrier configured to have an electrostatic latent image formed thereon; and the developing device according to claim 1, wherein the developing device is configured to develop the electrostatic latent image of the image carrier.

12. The developing device according to claim 1, wherein the guide member comprises a film member formed from a synthetic resin film.

13. The developing device according to claim 1, wherein the end portion of the guide member closest to the developer carrier is located closer to the developer carrier than is a portion of the chin that is closest to the end portion of the guide member.

14. The developing device according to claim 1, wherein the end portion of the guide member closest to the developer carrier is located closer to the developer carrier than is any portion of the chin.

15. The developing device according to claim 1, wherein the guide member is below a rotational axis of the developer carrier.

16. The developing device according to claim 1, wherein the inlet portion is below the developer carrier.

17. The developing device according to claim 1, wherein the image carrier is configured to hold an electrostatic latent image that is to be developed, and wherein a closest distance between the end portion of the guide member closest to the developer carrier and the image carrier is shorter than a distance between the downstream edge portion and the image carrier.

18. A developing device comprising:

a housing including a development opening and a containing unit configured to contain a developer;

a developer carrier configured to rotate to pass through the development opening while holding the developer in the containing unit of the housing;

an inlet portion of a flow path located in the housing at a portion including a downstream edge portion of the development opening on a downstream side in a rotation direction of the developer carrier, the inlet portion being configured to take in part of an airflow caused by a rotation of the developer carrier to allow the part of the airflow to flow over an outer surface of the housing; and a guide member extending toward the developer carrier from a portion of the housing on a side of the inlet portion opposite to the development opening, wherein the guide member is configured to guide the part of the airflow to the inlet portion, wherein an end portion of the guide member closest to the developer carrier is not in contact with a developer held on the developer carrier, wherein the end portion of the guide member closest to the developer carrier is located closer to the developer carrier than is a chin of the housing, the chin having a shape following an outer peripheral surface of the developer carrier, wherein the inlet portion and the guide member are configured to prevent the airflow from flowing outside the developing device, wherein an image carrier is located closer to the end portion of the guide member closest to the developer carrier than is the developer carrier, wherein the image carrier is configured to hold an electrostatic latent image that is to be developed, and wherein a closest distance between a portion of the housing on a side of the inlet portion opposite to the development opening and the image carrier is shorter than a distance between the downstream edge portion and the image carrier.

19. The developing device according to claim 18, wherein the image carrier is configured to hold an electrostatic latent image that is to be developed, and wherein a closest distance between the end portion of the guide member closest to the developer carrier and the image carrier is shorter than a distance between the downstream edge portion and the image carrier.

* * * * *